US005367227A

United States Patent [19]

Gademann et al.

[11] Patent Number: 5,367,227

[45] Date of Patent: Nov. 22, 1994

[54] CIRCUIT ARRANGEMENT FOR OPERATING A GAS-DISCHARGE LAMP

[75] Inventors: Lothar Gademann, Rottenburg; Ulrich Drews, Schwieberdingen; Wolfgang Jakob, Horb; Anton Mindl, Tübingen, all of Germany

[73] Assignee: Robert Bosch GmbH, Stuttgart, Germany

[21] Appl. No.: 840,731

[22] Filed: Feb. 21, 1992

[30] Foreign Application Priority Data

Sep. 1, 1989 [DE] Germany ..... 3929029

[51] Int. Cl.[5] ..... H05B 37/00

[52] U.S. Cl. ..... 315/290; 315/239; 315/240; 315/205

[58] Field of Search ..... 315/DIG. 7, 290, 173, 315/239, 240, 205, 171

[56] References Cited

U.S. PATENT DOCUMENTS 4,092,565 5/1978 Neal ..... 315/290
4,469,981 9/1984 Ruff et al. ..... 315/290
4,890,041 3/1988 Nuckolls et al. ..... 315/225
5,021,716 6/1991 Lesea ..... 315/DIG. 7

FOREIGN PATENT DOCUMENTS 0331840 9/1989 European Pat. Off. .
2060472 6/1972 Germany .
8201113 4/1982 WIPO .

*Primary Examiner*—Robert J. Pascal
*Assistant Examiner*—Reginald A. Ratliff
*Attorney, Agent, or Firm*—Spencer, Frank & Schneider

[57] ABSTRACT

A circuit arrangement for operating a gas-discharge lamp is proposed, in which the high voltage for starting the gas-discharge lamp is generated by means of the energy stored in a transformer or capacitor. In order to obtain a steep rise in voltage of the starting voltage, the starting voltage is provided to the gas-discharge lamp via a voltage-controlled switch. A break-over diode, which has very short switching times, is proposed as the voltage-controlled switch. The starting circuit is switched off after starting. This circuit arrangement is also particularly suitable for starting gas-discharge lamps which are warm from operation. In consequence, it is particularly suitable for motor vehicle headlights.

21 Claims, 2 Drawing Sheets

CIRCUIT ARRANGEMENT FOR OPERATING A GAS-DISCHARGE LAMP

PRIOR ART

The invention is based on a circuit arrangement for operating a generic gas-discharge lamp. A starter circuit for a high-pressure metal-vapour discharge lamp has already been disclosed in DE-OS 3,108,548, in which an LC series resonant circuit acts on the switchable primary winding of a transformer. Consequently, a high voltage, which starts the gas-discharge lamp, is induced in the secondary winding.

In this circuit arrangement, the secondary winding of the transformer remains connected to the burning circuit even after the gas-discharge lamp has been started. This results in additional losses which heat the starter unnecessarily. In addition, the rate of rise of the starter voltage as it pulses through the inductors is relatively slow, which as a result prevents immediate starting, especially of a warm gas-discharge lamp.

The LC series resonant circuit must also be tuned to resonance, which necessitates high quality components, with relatively tight tolerances, which are correspondingly expensive.

ADVANTAGES OF THE INVENTION

The circuit arrangement according to the invention comprises a gas-discharge lamp, a voltage-controlled switch means, a starting circuit connected in parallel with the gas-discharge lamp via the voltage-controlled switch means, and a burning circuit connected in parallel with the starting circuit via the voltage-controlled switch means and also connected in parallel with the gas-discharge lamp.

The circuit arrangement according to the invention has the advantage over the prior art in that the transformer is actively connected to the gas-discharge lamp only during the starting phase so that the power loss of the circuit arrangement is very small.

It is also particularly advantageous that the rate of rise of the starting voltage pulses is very high. Consequently, the starting energy stored in the transformer can be used virtually without loss for starting the gas-discharge lamp so that, in particular, even a warm gas-discharge lamp can be started reliably.

A further advantage can also be found in the decoupling of the starting circuit from the burning circuit, which is achieved by means of the voltage-controlled switch. Undesired feedthrough of the starting voltage pulses to the burning circuit is thus avoided. It is also particularly advantageous that no resonant circuit is required to increase the starting voltage. Consequently, the circuit design can be produced cost-effectively.

Other advantageous developments and improvements of the circuit arrangement are possible by means of the measures described below. It is particularly advantageous that the starting part is switched off during burning operation, since the high starting voltage is not required during burning operation.

It is also advantageous if a break-over diode is used as the semiconductor switch, since a break-over diode has a high reverse voltage and does not become conductive until the high starting voltage is reached. Such break-over diodes have a low residual current in the cut-off state and are of very low resistance in the conductive state in the case of breakdown.

A further advantage is that starting is monitored by means of a light sensor. As long as the lamp is not burning, the light sensor drives the control circuit to generate new starting pulses. After the gas-discharge lamp has been started, the light sensor suppresses the generation of further starting pulses.

In the case of a defect, for example as a consequence of a short-circuit or of an interruption, the lamp does not continue to burn, the signal from the light sensor can advantageously be used for monitoring the lamp circuit, controlling the lamp power or the light intensity or for switching off the high voltage. For safety reasons, this is particularly advantageous in the case of lamp replacement.

A particularly cost-effective construction of the circuit arrangement for generating the starting voltage is achieved by using an economy transformer, whose primary winding can be charged by a capacitor.

A further advantage can also be found in that the ignition coil of the motor vehicle engine is used instead of the transformer. In consequence, existing components are used in multiple roles so that the design of the circuit becomes very cost-effective.

The use of a gas-discharge lamp in a motor vehicle headlight is also advantageous. Since starting is ensured even in the case of a warm lamp, the lamp can also be used as a flashing light.

It has also been shown to be advantageous if a capacitor is connected upstream of the ballast, in order to support the starting process, the high voltage of which capacitor is decoupled from the generator by means of a diode.

A particularly simple circuit arrangement results if a second generator is used instead of the transformer.

Further advantages and improvements of the invention can be found in the description.

DRAWING

Embodiments of the invention are shown in the drawings and are described in more detail in the subsequent description.

Figure 4:
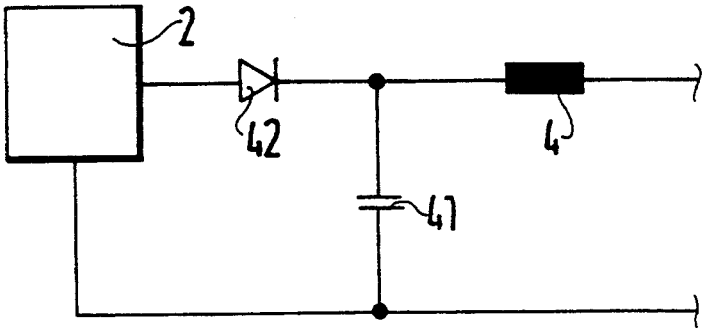

FIG. 4 a fourth embodiment.

DESCRIPTION OF THE PREFERRED EMBODIMENTS

Figure 1:
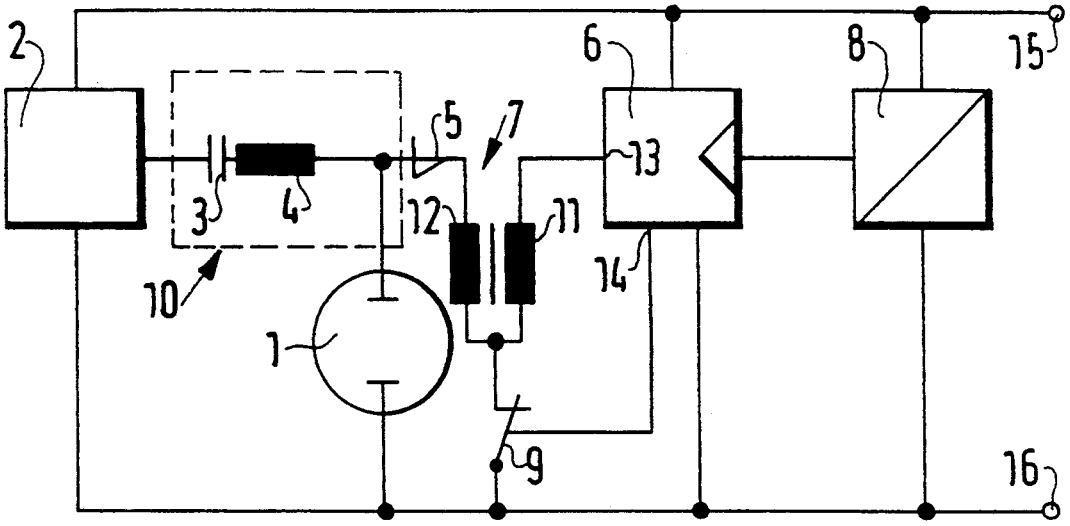
FIG. 1 shows a first embodiment.

FIG. 1 shows a first embodiment in which a gas-discharge lamp 1 is connected via the series circuit of a ballast 4 and a capacitor 3, that is to say the burning circuit 10 of the circuit arrangement, to the voltage output of an AC voltage generator 2. The AC voltage generator 2 is connected by means of its second output to the second electrode of the gas-discharge lamp 1, which is continued as an earth lead. Arranged in parallel with the gas-discharge lamp 1 is a series circuit which has a voltage-controlled switch 5, the secondary winding 12 of a transformer 7 and a controlled switch 9. The primary winding 11 of the transformer 7 connected by means of its one terminal to the switched side of the secondary winding and by means of its second terminal to a first output 13 of a control circuit 6. The control circuit 6 has a second output 14 which is connected to the control input of the controlled switch 9, which is preferably constructed as a semiconductor switch. The control circuit 6 is controlled by a light sensor 8 whose arrangement is selected such that it can identify the starting of the gas-discharge lamp 1. This circuit part is designated the pulse starting part.

The voltage is supplied to the light sensor 8, the control circuit 6 and the generator 2 via common leads which are formed by the terminals 15 and 16.

The following text describes the method of operation of this circuit.

As can be seen from the circuit diagram, in FIG. 1, the circuit arrangement essentially has two circuits for operating the gas-discharge lamp. The first circuit is formed by the generator 2, the capacitor 3 and the ballast 4 in conjunction with the gas-discharge lamp 1. In this circuit, the generator 2 supplies the burning voltage which is necessary for maintaining the burning operation of the gas-discharge lamp 1. Depending on-the lamp type, the necessary burning voltage is, for example, 60 to 120 volts. The operating frequency of the generator 2 is advantageously in the kHz region, since in this way the components and the generator are smaller and can be produced more cost-effectively and in addition the light output of the gas-discharge lamp is particularly high in this frequency region.

However, since several kilovolts (for example 5 to 15 kV) are required for starting the lamp, connected in parallel with the lamp is a starting circuit which essentially has the voltage-controlled switch 5, the transformer 7 and the control switch 9. The control circuit 6, which can be activated via the light sensor 8, is provided for generating the starting voltage and for monitoring the burning function. The control circuit 6 contains switching elements, timers, the voltage supply for the transformer, and monitoring elements for functional monitoring of the gas-discharge lamp and safety functions.

The switch 9 is initially closed for starting the gas-discharge lamp 1, so that the primary winding 11 of the transformer 7 can charge via the first output of the control circuit 6. After charging, the switch 9 is opened so that a voltage is induced in the secondary winding 12. With a suitable transformation ratio between the two windings, the induced voltage is sufficiently high to start the gas-discharge lamp 1. The voltage-controlled switch 5 is initially cut off in the case of a low induced voltage. If the induced voltage rises above the threshold value of the switch 5, it then becomes conductive in a virtually step-function manner so that a high voltage amplitude is available at the burning electrodes for starting the gas-discharge lamp. In this embodiment, a break-over diode was used as the voltage-controlled switch 5. Break-over diodes have the advantage that they have a very high resistance below their threshold voltage, which is matched to the starting voltage requirement of the lamp and is, for example, approximately 20,000 volts, so that the losses caused by leakage currents are very small. If the threshold voltage is exceeded, the break-over diode has a very low resistance, so that it can transmit the energy stored in the transformer 7 to the gas-discharge lamp 1. In this case, the gas-discharge lamp 1 is decoupled by means of the ballast 4 from the AC voltage generator 2 and the capacitor 3.

The capacitor 3 is provided in parallel with the starting circuit, in order to support the starting process in the burning circuit. Since the capacitor 3 is charged further during each starting attempt which has not yet been successful, it can pass its energy during the starting process via the ballast likewise to the hot electrode of the gas-discharge lamp and support the successful final starting attempt. Particularly in the case of a warm gas-discharge lamp, reliable starting is also supported in this way and the coupling of the burning circuit assisted.

A diode 42 can also be connected between the generator 2 and a capacitor 41 which can be further connected to a connecting terminal 16, preferably to earth (see FIG. 4).

In the first embodiment, the starting circuit was dimensioned such that an individual starting pulse lasts approximately for a few microseconds. If said pulse was not sufficient to start the lamp, further starting pulses are generated. The voltage on the capacitor 3 and on the gas-discharge lamp 1 rise continuously for each starting pulse. The charge voltage of the capacitor 3 is determined by the starting energy transmitted from the voltage-controlled switch 5 during the starting process. The charge voltage of the capacitor 3 is raised continuously since the capacitor was not discharged during an unsuccessful starting attempt.

After starting of the gas-discharge lamp 1, which is monitored by the light sensor 8, the control circuit 6 holds the switch 9 open so that renewed charging of the primary winding 11 of the transformer 7 is prevented. The voltage-controlled switch 5 returns to its high-resistance state, as it also does after each starting pulse, and hence decouples the starting circuit from the gas-discharge lamp 1. The burning operation is now maintained by the generator 2. In conjunction with the capacitor 3, the ballast 4 provides current limiting since the gas-discharge lamp 1 is of low resistance during the burning process. Resonance tuning between the capacitor 3 and the ballast 4, which is necessary in known starting circuits, is not required here. Ignition coils or suitable transmitters of a motor vehicle engine can also be provided instead of the transformer 7.

Photo transistors or photo resistors can be used as the light sensor 8. They recognize the visible radiation of a gas-discharge lamp 1 and emit a corresponding electrical signal which can be used to control the control circuit 6. The control circuit 6 furthermore has switching devices, for example comparators for current measurement, which prevent inadvertent starting in the case of a missing gas-discharge lamp 1 or of a short-circuit of the leads. This is necessary for safety reasons if this circuit arrangement is used for operating the headlight of a motor vehicle.

The control circuit 6 can control the burning current of the gas-discharge lamp as a function of the light, by means of a controller which is not shown.

A thyristor or a series-connected spark gap can also be used as the voltage-controlled switch. Series-connected spark gaps have the disadvantage, however, that they emit high interference radiation, which is undesirable in some circumstances, and in addition they are subject to wear. In contrast, the use of a break-over diode has the advantage that the break-over diode changes into the conductive state sufficiently quickly on reaching the break-over voltage, that is to say within a few nanoseconds. Such break-over diodes are already proposed in Patent Application EP 88/00456.

Figure 2:
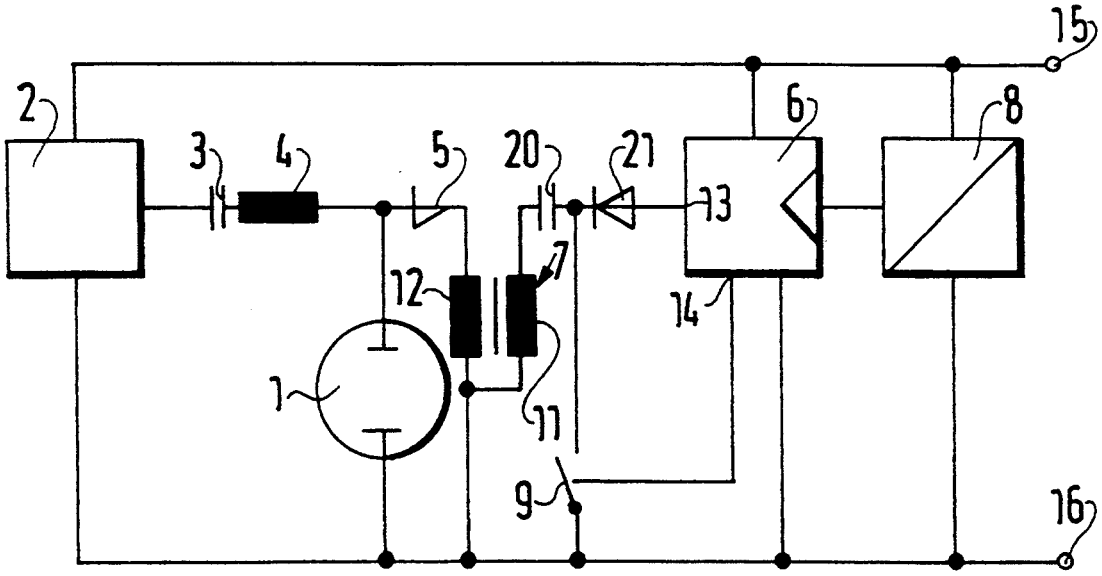
FIG. 2 shows a second embodiment.

A second embodiment of the circuit arrangement is shown in FIG. 2. Here, the drive of the transformer 7 is modified in comparison with the circuit arrangement shown in FIG. 1. Connected to the input terminal of the primary winding 11 of the transformer 7 is a second capacitor 20 which is charged from the output 13 of the control circuit 6 via a diode 21. A switch 9 is connected to earth between the capacitor 20 and the diode 21. After charging the capacitor 20, this switch 9 is closed via the output 14 of the control circuit 6, as a result of which the starting voltage is induced in the secondary winding 12 of the transformer 7. After reaching the break-over voltage, the voltage-controlled switch 5 becomes conductive and transmits the energy stored in the transformer 7 very quickly to the gas-discharge lamp 1. As in the first embodiment, the circuit arrangement is dimensioned such that the capacitor 3 can receive a plurality of charge pulses until the starting voltage for the gas-discharge lamp 1 is reached. After starting, the generator 2 takes over the power supply for the gas-discharge lamp 1, while the transformer 7 remains switched off.

Figure 3:
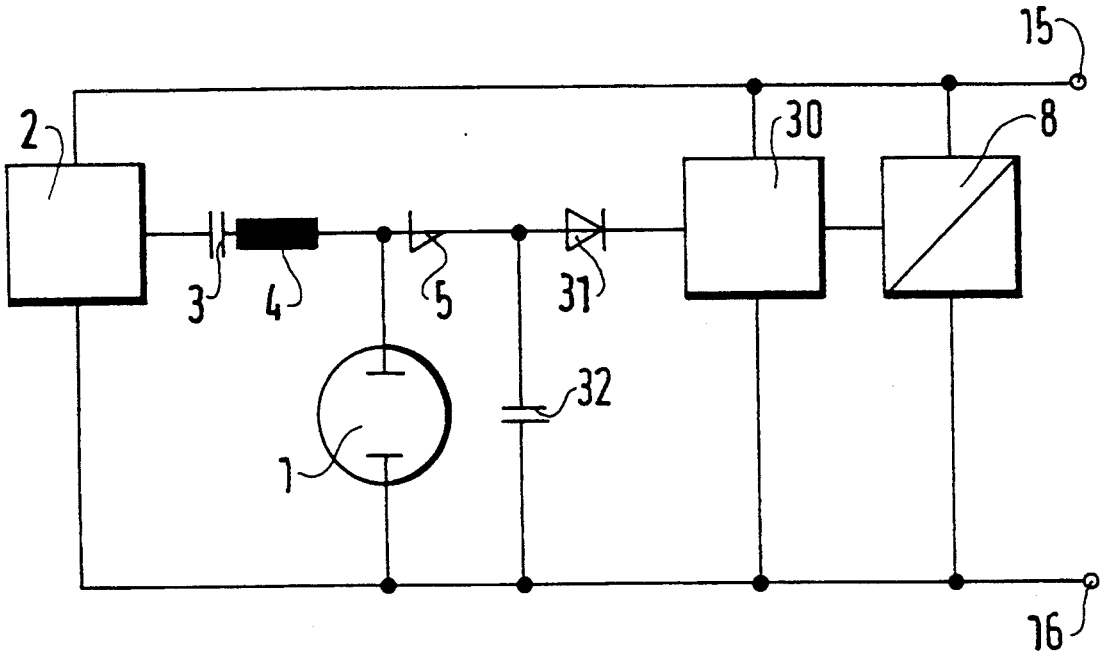
FIG. 3 shows a third embodiment.

A third embodiment of the invention, according to FIG. 3, provides for a high-voltage generator 30, for example a starting transmitter, which charges a capacitor 32 via a diode 31. The capacitor 32 can be connected in parallel with the gas-discharge lamp 1 via the voltage-controlled switch 5. On reaching the break-over voltage, the energy stored in the capacitor 32 switches the controllable switch 5 through to start the gas-discharge lamp 1. In other respects, this circuit arrangement operates as the previously described embodiments.

The proposed embodiments can also be operated on a DC voltage network if the available DC voltage, for example from the battery of a motor vehicle, is pulsed to generate a pulsed high voltage. Such chopper circuits are known and do not need to be described more detail.

If gas-discharge lamps 1 with a low burning voltage, for example 12 volts, are used, then the generator 2 can be replaced by a battery. In this case, the capacitor 3 must be replaced by a capacitor connected to earth.

We claim:

1. Circuit arrangement for operating a gas-discharge lamp, comprising:

a burning circuit, connected in parallel to the gas-discharge lamp, having a voltage generator and an inductor as a ballast; and a starting circuit, connected in parallel with both the gas-discharge lamp and the burning circuit via a voltage-controlled switch, having a transformer with a primary winding and a secondary winding which is connected in parallel to the gas-discharge lamp, and a control circuit which acts on the primary winding of the transformer, wherein the secondary winding of the transformer is connected in parallel with the burning circuit via the voltage-controlled switch.

2. Circuit arrangement according to claim 1, wherein the primary winding of the transformer is arranged to be switched via a capacitor.

3. Circuit arrangement according to claim 1, wherein the transformer is an ignition coil.

4. Circuit arrangement for operating a gas-discharge lamp, comprising:

a burning circuit, connected in parallel to the gas-discharge lamp, having a voltage generator and an inductor as a ballast; and a starting circuit, connected in parallel with both the gas-discharge lamp and the burning circuit via a voltage-controlled switch, having a further voltage generator and a switchable capacitor, in that the further voltage generator charges the switchable capacitor connected in parallel with the gas-discharge lamp via the voltage-controlled switch.

5. Circuit arrangement according to claim 1, wherein the voltage-controlled switch substantially electrically decouples the starting circuit of the circuit arrangement from the burning circuit during a burning operation of the gas-discharge lamp and substantially electrically couples the starting circuit to the gas-discharge lamp during a starting operation of the gas-discharge lamp.

6. Circuit arrangement according to claim 1, wherein the voltage-controlled switch is a break-over diode.

7. Circuit arrangement according to claim 1, further comprising a capacitor serially connected between the voltage generator and the ballast.

8. Circuit arrangement according to claim 1, wherein a first terminal of a diode and a capacitor are connected between the ballast and the voltage generator, a second terminal of the diode is connected to the voltage generator, and a second terminal of the capacitor is connected to a connecting terminal.

9. Circuit arrangement according to claim 1, further comprising a light sensor which records the light of the gas-discharge lamp and acts on the control circuit to end the charging process when the gas-discharge lamp starts.

10. Circuit arrangement according to claim 1, wherein the control circuit interrupts the charging process when the gas-discharge lamp is missing or has a short-circuit.

11. Circuit arrangement according to claim 1, wherein the circuit arrangement controls a motor vehicle headlight.

12. A circuit arrangement for operating a gas-discharge lamp comprising:

a gas-discharge lamp;

a voltage-controlled switch means;

a starting circuit connected in parallel with said gas-discharge lamp via said voltage-controlled switch means; and a burning circuit connected in parallel with said starting circuit via said voltage-controlled switch means and also connected in parallel with said gas-discharge lamp.

13. A circuit arrangement according to claim 12, wherein said starting circuit comprises a control circuit and a transformer having a primary winding connected to said control circuit and a secondary winding connected via said voltage-controlled switch means to said gas-discharge lamp.

14. A circuit arrangement according to claim 12, wherein said burning circuit comprises the serial connection of an AC voltage generator, a capacitor, and an inductor which functions as a ballast.

15. A circuit arrangement according to claim 12, wherein said burning circuit comprises a voltage generator, a diode connected to said voltage generator to form a serial connection, a capacitor connected in parallel with said serial connection, and an inductor, which functions as a ballast, connected to said capacitor and to said diode.

16. A circuit arrangement according to claim 12, wherein said starting circuit comprises a control circuit, a charging capacitor coupled to said control circuit, and a transformer having a primary winding connected to said charging capacitor and a secondary winding connected via said voltage-controlled switch means to said gas-discharge lamp.

17. A circuit arrangement according to claim 12, wherein said starting circuit comprises a control circuit having a high voltage generator, a charging capacitor coupled to said high voltage generator and connected in parallel via said voltage-controlled switch means to said gas-discharge lamp.

18. A circuit arrangement according to claim 12, wherein said voltage-controlled switch means comprises a break-over diode.

19. A circuit arrangement according to claim 12, further comprising a light sensor connected to said starting circuit which measures the light emitted from said gas-discharge lamp and uses this information to control said starting circuit.

20. A circuit arrangement according to claim 12, wherein said starting circuit comprises an ignition coil which functions as a transformer.

21. A circuit arrangement according to claim 12, wherein said voltage-controlled switch means suddenly changes to a conductive state, to couple the starting circuit to the gas-discharge lamp, when a high predetermined charging voltage is reached and remains in said conductive state until a predetermined minimum current through said voltage-controlled switch is no longer maintained.

* * * * *